United States Patent [19]

Stephenson

[11] Patent Number: 4,777,403

[45] Date of Patent: Oct. 11, 1988

[54] DYNODE STRUCTURES FOR PHOTOMULTIPLIERS

[76] Inventor: K. E. Stephenson, 103 Ingleside Ave., Pennington, N.J. 08534

[21] Appl. No.: 54,990

[22] Filed: May 28, 1987

[51] Int. Cl.[4] ..... H01J 43/18

[52] U.S. Cl. ..... 313/533; 313/535; 313/536

[58] Field of Search ..... 313/536, 535, 533

[56] References Cited

U.S. PATENT DOCUMENTS

| | | | |
|---|---|---|---|
| 3,649,868 | 3/1972 | Bensussan | 313/536 X |
| 3,753,023 | 8/1973 | Sommer | 313/536 X |
| 4,112,326 | 9/1978 | Faulkner | 313/536 |
| 4,431,943 | 2/1984 | Faulkner et al. | 313/533 |
| 4,446,401 | 5/1984 | Faulkner et al. | 313/533 |
| 4,593,229 | 6/1986 | McDonie et al. | 313/533 |

FOREIGN PATENT DOCUMENTS

| | | | |
|---|---|---|---|
| 0167946 | 9/1984 | Japan | 313/533 |

*Primary Examiner*—Palmer C. DeMeo

*Attorney, Agent, or Firm*—Henry N. Garrana

[57] ABSTRACT

The first of a plurality of dynodes in a photomultiplier tube is made of a weldable nickel-beryllium alloy having a beryllium oxide layer thereon, formed into a desired shape from spot-welded segments. The dynode itself is then spot-welded to a support element. In one aspect of the invention, this first dynode has a scoop form. It is followed by a second dynode of spherical shape, made of a copper-beryllium alloy. A flap made of nickel-beryllium is juxtaposed to intercept photoelectrons that otherwise may escape photomultiplication in either the first or second dynodes. Additional venetian-blind type dynodes are employed to obtain the required photomultiplication.

10 Claims, 9 Drawing Sheets

DYNODE STRUCTURES FOR PHOTOMULTIPLIERS

BACKGROUND OF THE INVENTION

1. Field of the Invention

This invention relates to photomultiplier tube structures and, more particularly, to a novel dynode structure for a photomultiplier tube suitable for use with a low-light scintillator.

2. Background of the Prior Art

Many situations require precise measurements of the photon outputs from sources of gamma rays, x-rays, low level visible light and the like. In principle, a quantum of energy from a source of interest is received at a photocathode and causes the emission of electrons therefrom. This initial supply of electrons reaching a photocathode normally is too small to permit practical measurements. Controlled amplification of this initial electron emission with the minimum amount of "noise" in the process is highly desirable, and is provided by a photomuliplier tube.

Typically, the incident energy is received at a semitransparent thin cathode film in the photomultiplier tube which receives incident radiation on one side and emits a corresponding output of electrons from its other side, inside the photomultiplier tube. These photoelectrons are focused or guided by electrostatic or electromagnetic fields to the active surfaces of a set of dynodes. Where electron flow is controlled by electrostatic fields, one or more grids may be provided between successive dynodes to contain the flow of electrons. Finally, the amplified output of electrons is received for analysis and interpretation in known manner.

A major consideration in the design of any photomultiplier tube is how to shape and position the dynodes, so that all of them are properly utilized and no electrons are lost to support structures within the photomulitplier tube or deflected in other ways. It is not necessary that the electrons from each dynode or stage come to a sharp focus on each succeeding stage. The force fields, however, should control the electron flows to reach a generally central location on each receiving dynode. This receiving portion of the dynode surface then becomes the emission point for the next stage. It is not essential for efficient operation of the photomultiplier tube that the emission point be located at the optimum location of each dynode. However, if the flow of electrons received by each dynode is not adequately controlled, electrons tend to increasingly diverge from the center of each successive dynode and this, in turn, may lead to the skipping of successive stages by the flow of electrons with consequent loss of amplification gain.

It is very important to provide good collection of secondary electrons from stage to stage within the photomultiplier tube. It may also be important to minimize the time-spread of electron trajectories from the first to the last dynode. One solution is to provide strong electric fields at the surfaces of the dynodes to assure high initial acceleration of the electrons. It is usually also important to design the dynode surface configurations to thereby provide nearly equal transit times between dynodes regardless of the point of emission of electrons on a given dynode.

In utilizing such photomultipliers, relatively large photocathode areas may be required for efficient scintillator coupling. For a relatively large photocathode, the first problem is to design an efficient "photocathode to first dynode" electron flow. Failure to guide the photoelectrons properly through the first dynode will result in a high noise-to-signal ratio and this will result in poor pulse-height resolution characteristics. Regenerative effects, i.e., an open path in the tube through which occasional ions or light can feed back from the output end to the photocathode, must be avoided.

A number of known photomultiplier structures are described in the RCA photomultiplier handbook (1980 Edition), particularly at pages 26–35 thereof, and these include the structures illustrated in FIGS. 1, 2, and 3 of this application.

FIG. 1 illustrates a known photomultiplier tube structure 20 with a front window 22, a semitransparent photocathode 24 to generate electron flow 26, a first electron focusing element 28 to apply a skewed focusing electrostatic field to the photoelectron flow 26, and a first shaped dynode surface 30 to receive the focused photoelectron flow. Secondary emission 32 of electrons flows in typically highly curved paths from first dynode 30 to a second dynode 34, the receiving surface of which is capable of generating a corresponding amplified emission of electrons received in succession by other dynodes such as 36, 38 (and the like) that are arranged in a circular "cage" manner to end with an anode 40 coupled to an electrical circuit for analyzing the amplified output of the incident energy flow. As seen from FIG. 1, particularly between the first dynode 30 and the second dynode 34, the paths follows by successively generated electrons between adjacent dynodes are not all of the same length. Also, because of the distribution of electrostatic field strength between dynodes, electrons are not all equally accelerated in their passage through the dynode cage. The actual shapes selected for the dynodes have a strong influence on the paths taken by the successive electron flows and hence on the disparity between the time taken for the results of photoelectron emissions from various parts of the photocathode to reach ceiling electrode 40. The various electron paths are very complex and, consequently, it is a major problem to correctly shape such dynodes.

Incident radiation enters the photomultiplier tube of FIG. 2 at a front surface 62, to reach a semitransparent photocathode 64 which emits photoelectrons 66 guided by a focusing electrode 68 to an active surface of first dynode 70. An emission of electrons 72 from the first dynode 70 then reaches the active surface of a second dynode 74, and so on through a plurality of similar dynode surfaces to reach collecting electrode 80. Suitably charged grids, such as 76 for the first dynode and 78 for the second dynode, are provided with each dynode to reduce the noise-to-signal ratio by guiding the successive electron flows between dynodes to reduce straight transfer of electrons within the photomultiplier tube 60. Such a structure is known as a "box-and-grid" structure and has individual dynode boxes, each open at the exit end and having a grid at its entrance. An electric field generated by the grid penetrates the preceding dynode region and aids in the withdrawal of secondary electrons, while also eliminating a retarding field that would be caused by the potential dynode. Therefore, because the field penetration is rather weak, the electron transit time between dynodes of the box and grid type is relatively slow and has a rather large time spread.

Another known photomultiplier tube structure 100, of the type known as a "venetian-blind" structure, is illustrated in FIG. 3. This structure is very flexible as to the number of stages and, like the previously discussed "cage" and "box-and-grid" structures, has a front window 102 through which energy reaches a photocathode 104 to generate emission 106. A focusing electrode 108 directs the flow of photoelectrons 106 to first dynode surfaces 110 from which a secondary emission of electrons 112 flows to second dynode surfaces 114. Control grids 116 for the first dynode, 118 for the second dynode, and the like are provided for by a plurality of grids between the first dynode and the receiving electrode 120. This venetian-blind structure is flexible as to the number of stages that may be provided. However, it is rather slow in response time and some of the secondary electrons may be lost because of the interposition of the grids between stages, as was the case with the "box-and-grid" structure illustrated in FIG. 2.

FIGS. 1, 2 and 3 are generally schematic, and focus on the electron paths rather than on details of the structure. FIG. 4, however, illustrates certain details of venetian-blind dynodes. Thus, photomultiplier tube 130 has a front window 132, a semitransparent photocathode 134, and a first grid 136 associated with a first dynode surface having venetian blinds 140 formed in a generally cup-like shape with a rim portion 144 held by attachment to a circular flange piece 146. Successive venetian-blind elements are held adjacent each other, e.g., 140 and 142, each with their respective grids 136 and 138 attached. Adjacent elements are separated by ceramic elements 148, and the tube ends in a rear surface 150. The shape of the typical venetian-blind structure is better understood with reference to FIGS. 5 and 6. The venetian-blind structure, comprising the blinds 140 and the rim 144, must be made of a material capable of generating the desired secondary emissions and must be combined with other elements of the photomultiplier tube in a sturdy and efficient manner. In other words, rim 144 of a venetian-blind element must be strongly attached to support element 146 and have good electrical contact therewith.

The typical practice is to use venetian-blind elements of copper-beryllium alloy (Cu-Be) with a specially treated active surface. Unfortunately, because of the high conductivity of copper in the alloy, it is virtually impossible to spot weld each venetian-blind structure to support element 146 typically made of Kovar(TM). A pragmatic solution, illustrated in the partial cross-sectional view of FIG. 7, is to provide, for example, a venetian-blind element with blind portions 140 and a relatively flat circult annular rim 152. Support flange 146 is provided with an L-shaped cross-section rim having a cylindrical portion 156 and an annular flat ring portion 158, to which is attached a crimping element 160, to receive and crimp in place the flat annular rim portion 152 of the venetian-blind element and a suitable shaped annular rim portion 154 of grid 136. In other words, each venetian-blind element and its associated grid are held in place within the photomultiplier tube by the crimping action of crimping element 160. Unfortunately, for photomultiplier tube usages that involve high vibration and high temperature environments, this method is unsatisfactory.

A casual review of these problems might suggest that the crimping element be spot welded into attachment with support element 146 and that the grid, likewise, be spot welded to its associated venetian-blind element. Unfortunately, the most suitable material for forming dynodes of the venetian-blind and other types has been found to be a copper-beryllium alloy in which the principal constituent is copper. While this alloy is good as a secondary electron emitter, and thus for dynode structures, the predominance of copper in the alloy causes the same to have a very high conductivity. This makes it virtually impossible to spot weld such elements in place. A highly suitable material for the grids, e.g., 136 in FIGS. 4 and 7, and focusing electrodes such as 28 in FIG. 1, is nickel.

The only use of nickel, for forming a dynode element is suggested in U.S.S.R. Patent No. SU455397, for a device that apparently determines the shape of an x-ray emitting surface (mirror) and eliminates the afocal emission of the radiation characteristics, in which a dynode is made from two different materials. The central patch of the dynode surface is made from a material the specific emission characteristics of which are to be used in the materials structure analysis, e.g., molybdenum or silver, and a surrounding ring portion is made from a material which emits significantly longer wavelength and is easily alternated, e.g., iron or copper. For soft x-rays, the central patch in this device could be made of chromimum, iron, cobalt, nickel or copper, while the outside ring could be of beryllium or aluminum. The function of this device apparently requires that individual specific elements be used for the central patch and the surrounding ring.

There is, therefore, a need for a photomultiplier dynode structure which allows the designer to spot weld individual dynode surfaces for proper affixation of the dynodes for high quantum efficiency, i.e., the ability to provide high secondary emissions.

Apart from the weldability desired in the dynode material, since the first dynode is most important to photomultiplier resolution, it is important that at least the first two dynodes be carefully shaped and placed with respect to each other and successive dynodes for optimum performance thereof. There is, therefore, also a need for a combination of dynode surface geometries in a photomultiplier tube to provide high resolution with relatively weak input from a scintillator under conditions of high vibrational inputs and high temperature.

DISCLOSURE OF THE INVENTION

Accordingly, it is an object of this invention to provide individual dynode elements having high quantum efficiency that are also suitable for spot welding affixation to support elements within photomultiplier tubes.

It is another object of this invention to provide dynode elements that are capable of being spot welded to associated electrical grids as well as to support elements.

A further object of this invention is to provide a dynode structure in a photomultiplier tube that provides sturdy mounting of active dynode surfaces in a manner capable of withstanding high vibrational inputs.

An even further object of this invention is to provide dynode structures in a photomultiplier tube for operation at elevated temperatures.

Yet another object of this invention is to provide dynode structures in a photomultiplier tube for use with low level inputs with a high signal-to-noise ratio.

An even further related object of this invention is to provide in a single photomultiplier tube a combination of dynode surface configurations capable of providing high resolution of low level inputs without an unduly prolonged response time.

These and other objects of this invention are realized in a preferred embodiment by providing in a photomultiplier tube having a photocathode, a focusing electrode, an anode and at least one dynode, a first dynode comprising a weldable nickel-beryllium alloy (Ni-Be) positioned to receive the focused photoelectrons thereby to emit a first amplified electron flow. In one aspect of this invention, the first dynode has a scoop form and is made of spot-welded segments. In another aspect of the invention a Ni-Be alloy flap is located between a first and a second dynode to control photoelectron leakage.

In yet another aspect of the invention the first dynode has a spherical shape.

Still other objects and advantages of the present invention will become readily apparent to those skilled in the art from the following detailed description wherein only the preferred embodiments of this invention are disclosed in detail simply to illustrate the best mode contemplated for carrying out the invention. As will be appreciated, this invention is capable of being utilized in other and different embodiments, and has several details capable of modification in various obvious respects, all without departing from the invention. Accordingly, the drawing and description provided herewith are to be regarded as illustrative in nature and not as restrictive.

DESCRIPTION OF THE PREFERRED EMBODIMENT

Weldable Nickel-Beryllium Alloy Dynode

Figure 1:
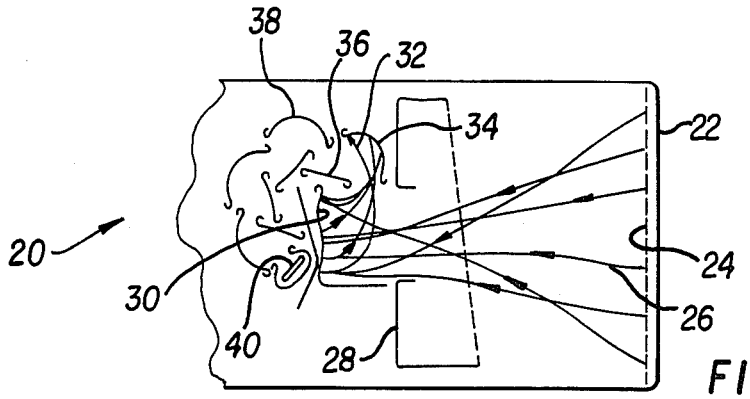
FIG. 1 PRIOR ART
FIGS. 1, 2 and 3 are schematic views, in longitudinal cross-sections, of relevant portions of known photomultiplier tube structures.
Figure 2:
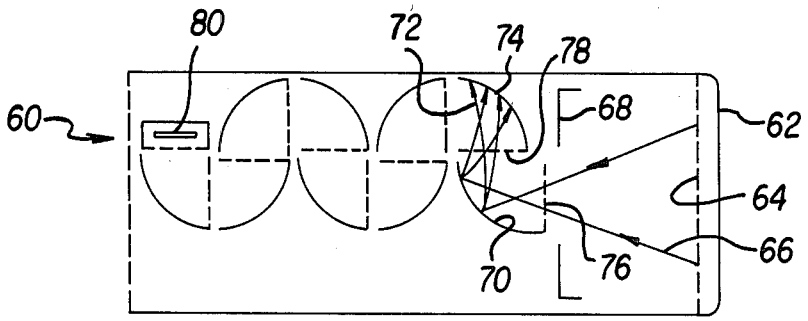
FIG. 2 PRIOR ART
Figure 3:
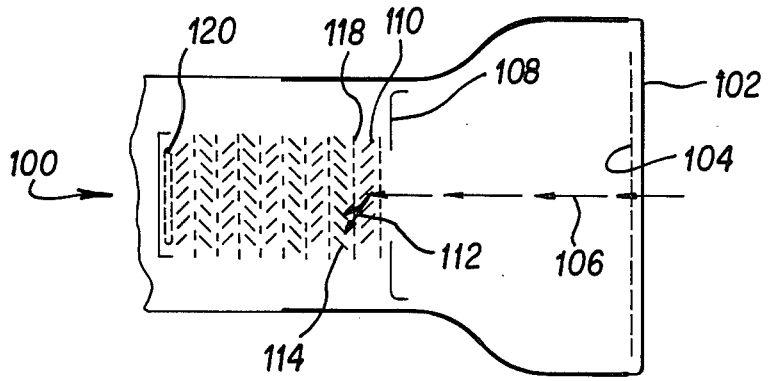
FIG. 3 PRIOR ART
Figure 4:
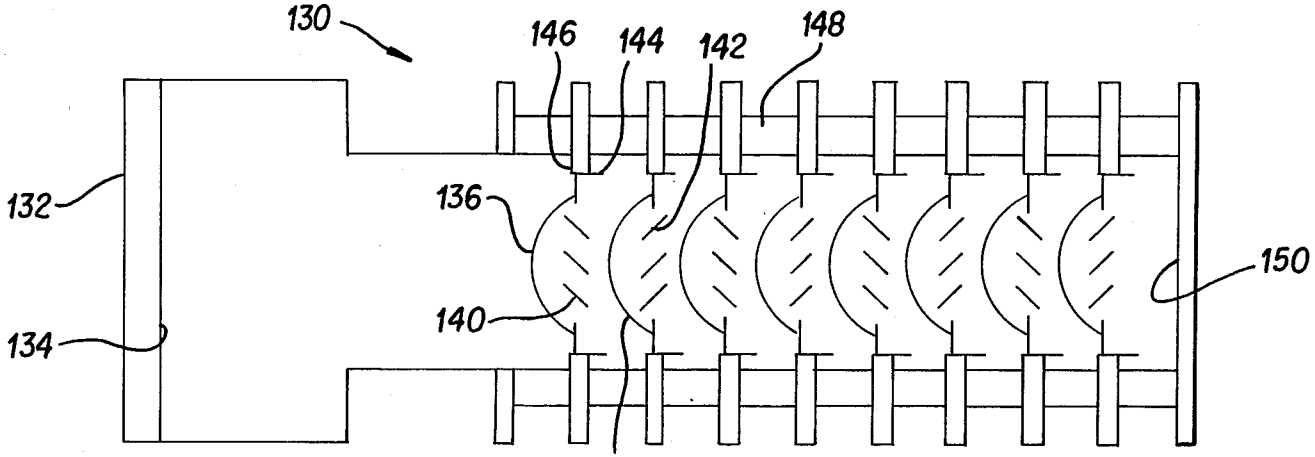
FIG. 4 PRIOR ART
FIG. 4 is a longitudinal cross-sectional view of a known venetian-blind type dynode structure in a photomultiplier tube.
Figure 6:
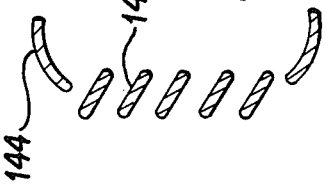
FIG. 6 PRIOR ART
FIGS. 5 and 6, respectively, are the front elevation view and a vertical cross-sectional view of a typical venetian-blind element of the type incorporated in the structure of FIG. 4.
Figure 5:
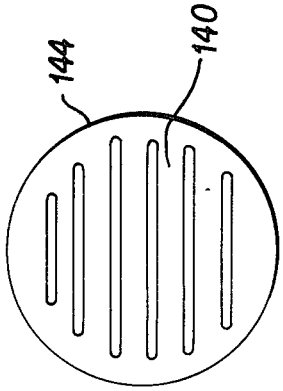
FIG. 5 PRIOR ART
Figure 7:
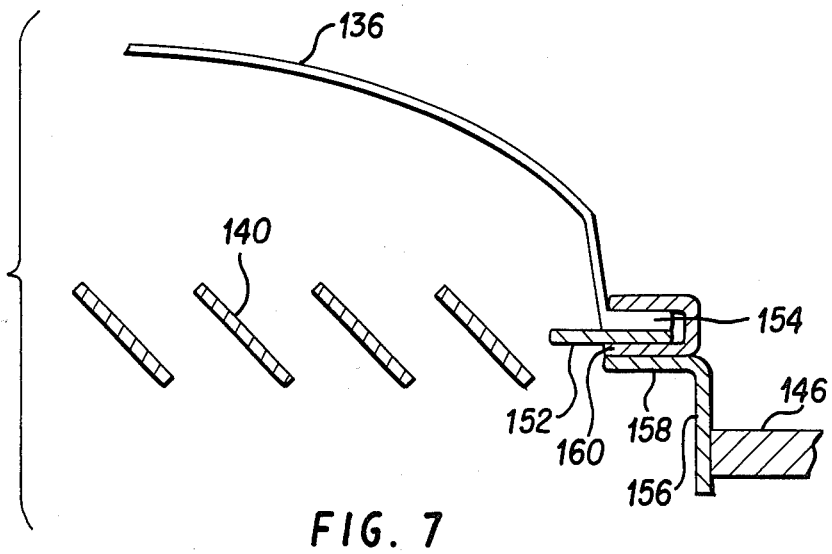
FIG. 7 is a partial transverse cross-sectional view of a portion of a venetian-blind dynode structure and control grid crimped to a support element.

The present state of the art of dynode structures relies principally on copper-beryllium alloys (Cu-Be) formed into the desired dynode shapes. In such alloys, the copper tends to be the predominant material and its physical properties, particularly its high thermal and electrical conductivities, characterize the alloy. The dynode elements are very thin and small. Cu-Be dynodes are heated in an oxygen atmosphere to generate a beryllium oxide (BeO) useful layer that receives incident electrons and emits secondary electrons in response. As illustrated in FIG. 7, a conventional technique for holding such a copper beryllium venetian-blind dynode element is to crimp the element and its associated grid together by a metal crimping element such as 160 in FIG. 7. The crimping element 160 is itself attached to supporting element 146 in any known manner.

The Russian reference cited earlier relates to a different function and evidently contains a "dynode made from two different spectrum emitting metals". The materials do not appear to be used in alloy form and each material has its own integrity, i.e., the characteristics of the central portion are distinctly different from the characteristics of the outer ring portion. Although this disclosure mentions nickel, copper and beryllium, the use of a Ni-Be alloy, particularly for its weldability characteristics, does not appear to have been considered.

Through empirical research and development, it has been discovered that nickel beryllium alloys can be formed into elements of suitable shape and size and that such alloys are weldable by spot-welds in a highly advantageous manner in photo-optical equipment, e.g., photomultiplier structures. Suitable alloy compositions of this type are exemplified by (1) Kawai Berylco Nickel Alloy 440 (nominally 1.95% beryllium, 0.5% titanium, and the balance nickel plus minor impurities, by weight) and (2) Brush Wellman Nickel Alloy 360 (nominally 1.8%–2.0% beryllium, 0.5%–1.0% titanium and the balance nickel with impurities, by weight). These are commercially available Ni-Be alloys of the type that have been found to be suitable as secondary emitting surfaces after treatment as described below.

Pieces of this Ni-Be material, each formed to suitable shape, e.g., with flanges for spot-welding, can be spot-welded in normal manner, preferably after the surface of the elements has been activated as described below. Thus, such elements may be spot-welded to Kovar(TM)

and hence to the glass tube portion of a typical photomultiplier tube. By contrast, especially after activation of a surface, Cu-Be alloy elements are extremely difficult if not impossible to spot-weld in place.

The dynode surface activation schedule for the Ni-Be alloys mentioned above and the conventionally used Cu-Be alloy are similar. Very briefly, the dynode surface activation schedule consists of the following steps:

(a) the dynode elements are heated to 350° C. under vacuum and held under these conditions for 3 hours;

(b) the temperature is raised to 700° C. while maintaining vacuum;

(c) the temperature is maintained at 700° C. while pure oxygen is introduced to be at a pressure between 500 mTorr and 1 Torr for a period of approximately 20 minutes;

(d) the oxygen is thereafter pumped out to return the system to high vacuum; and (e) the element is maintained in vacuum and allowed to cool overnight to room temperature.

It is believed that maintenance of the Ni-Be elements under high vacuum at approximately 700° C. causes beryllium in the alloy to diffuse to the surface, so that the surface is beryllium-rich. The maintenance of the high temperature and low pressure in the pure oxygen atmosphere is believed to then cause oxidation of beryllium at the element surface, resulting in a thin layer of BeO that can serve as a secondary emission surface for the dynode. As noted, the Ni-Be after such an activation process can be comfortably spot-welded in place without any deleterious effects on the activated surface qualities or extent.

The freedom to spot-weld portions of dynode elements or complete dynode elements to support the same affords a photomultiplier tube designer all the advantageous qualities of the traditional Cu-Be alloy with the added advantages of superior strength, reliability and, in general, ease of manufacture. The useful Ni-Be alloys are commercially available; it is found that they can be formed into complex shapes in small sizes and thicknesses, and the resultant system is capable of withstanding much higher vibrational inputs and temperatures than is possible with the conventional Cu-Be dynode elements.

Figure 8:
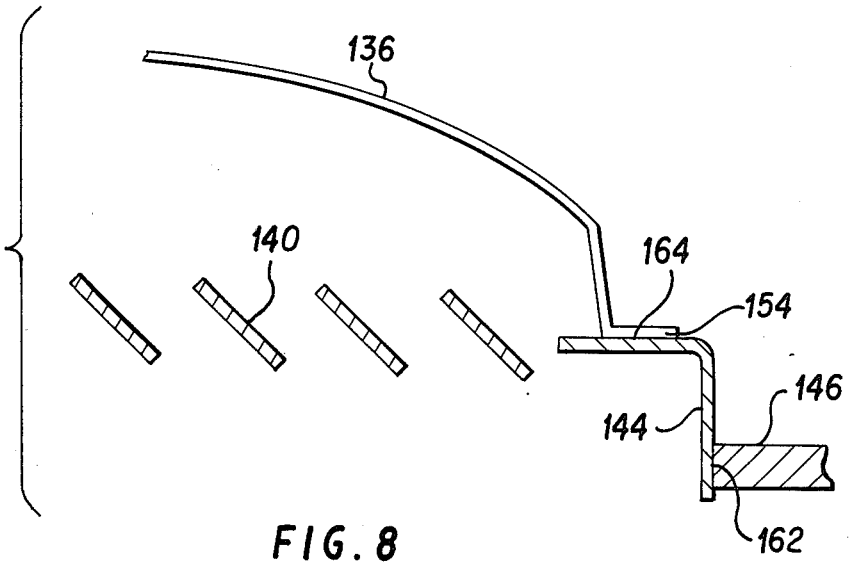
FIG. 8 is a partial transverse cross-sectional view of a dynode structure and grid, according to a preferred embodiment of this invention, welded to a support element therefor.

As best seen in FIG. 8, an exemplary venetian-blind dynode element has venetian-blinds 140 and a cylindrical rim portion 144, and may be made of nickel beryllium alloy according to this invention. It can be spot-welded to a portion 154 of a typical nickel grid 136 at a common interface 164. Likewise, such an exemplary venetian-blind dynode element may be conveniently spot-welded to a Kovar(TM) an iron cobalt alloy support element 146 at a common interface 162. Geometries and locations of the spot-welds as exemplified in the illustration of FIG. 8, by "x", are merely illustrative. As described more fully hereinbelow, the first and second dynodes in a photomultiplier tube are particularly important and the first dynode, according to a preferred embodiment of this invention, is made of Ni-Be spot-welded to a Kovar(TM) support. Such spot-welding may be performed in conventional manner to conventional spot-welding schedules, i.e., at operating conditions that could be readily determined by persons skilled in the welding arts.

Preferred Nickel Beryllium Dynode Structures Suitable for Photomultipliers

Figure 9:
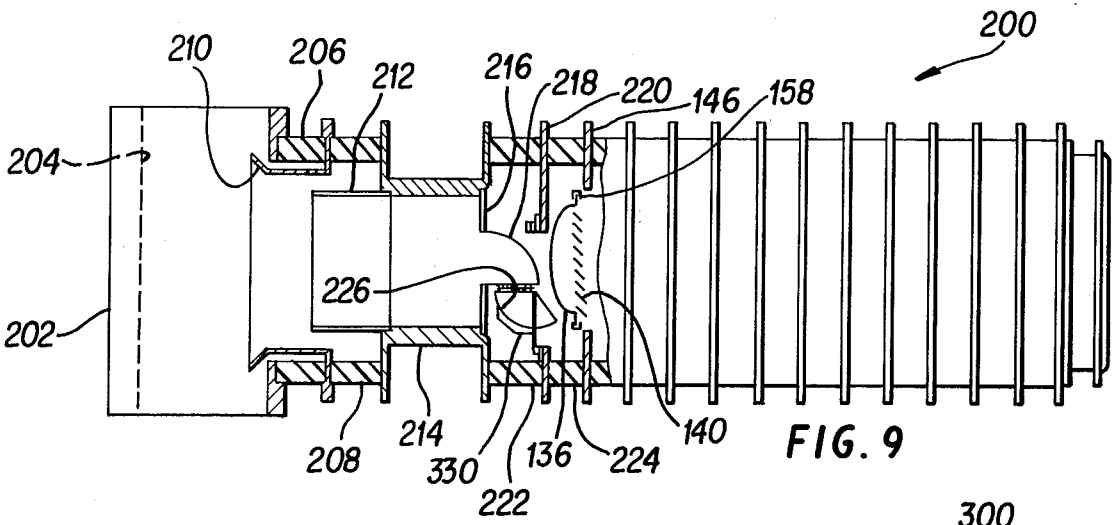
FIG. 9 is a longitudinal view, in partial vertical cross-section, illustrating a light receiving end and the first three dynode elements in the photomultiplier tube according to a preferred embodiment of this invention.

As best seen in FIG. 9, in one embodiment of the present invention the cooperating dynode elements form the inventive hybrid mixture of the "box and grid" and "venetian-blind" dynode structures known in the prior art. A transparent window 202 of the photomultiplier tube 200 conveys photon input to a semitransparent photocathode 204, causing generation of photoelectrons (not shown) therefrom inside the photomultiplier tube 200.

A first photoelectron-focusing electrode 210 funnels the photoelectrons generated by photocathode 204 toward the tube axis. A second focusing electrode 212, preferably coaxial with first focusing electrode 210, further assists in this photoelectron focusing process.

A generally cylindrical tubulation element 214 (seen in more detail in FIGS. 17*a* and 17*b*) is traversed by the focused electron flow substantially along the axis of the photomultiplier tube 200 to an activated surface of the first dynode 218.

The first dynode 218, in this particular embodiment, has a spherical shape that is supported by a Kovar(TM) support element immediately after tubulation body 214 in the photoelectron flow direction. The first dynode 218 in this embodiment is made of known conventional Cu-Be and is affixed to Kovar(TM) support element 216.

Figure 16:
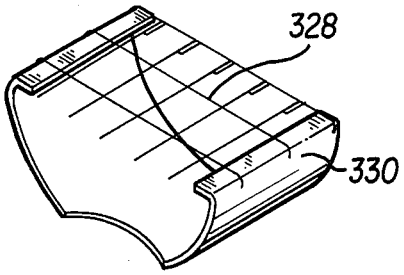
FIG. 16 is a perspective view of the grid support coacting with the second dynode according to this invention.

Below the electron exit portion of first dynode 218 is located a second dynode 226 that, like first dynode 216, has a generally spherical shape. A grid 328, which may optionally consist of parallel or crisscrossing wires, is interposed between first dynode 218 and second dynode 226. It is supported by a grid support 330, best seen in FIG. 16, a short distance from the axis of the photomultiplier tube 200.

Cylindrical ceramic spacer elements 206, 208, 222, 224 and the like, as best understood with reference to FIG. 9, are utilized to space apart various Kovar(TM) support elements such as 216, 220 and 146. Kovar(TM) is a proprietary material with a coefficient of expansion comparable to that of glass. Therefore, it is an extremely useful material for compact photomultiplier tube structures. Furthermore, a great advantage of using Ni-Be in forming various dynodes is that Ni-Be can be spot-welded to Kovar(TM). This immensely simplifies the designer's job of providing good, reliable affixation of the dynodes for cooperating with an external circuit as exemplified in FIG. 18.

It was found that the embodiment illustrated in FIG. 9 was somewhat limited in that it would capture principally only those electrons that were focused to travel close to the axis of the photomultiplier tube 200. An improvement over this structure, per FIG. 11, is described hereinbelow.

Figure 11:
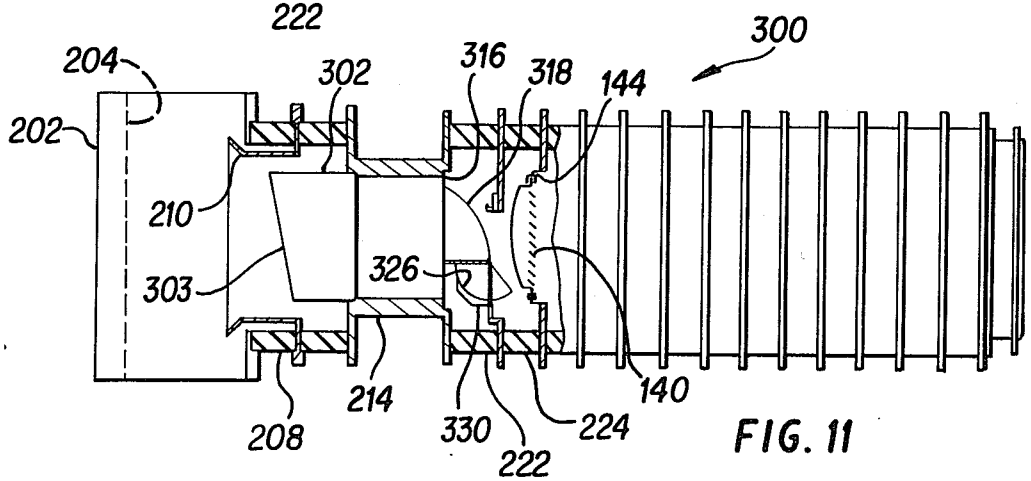
FIGS. 10 and 11, respectively, are a front vertical elevation view and a longitudinal view in partial vertical cross-section of a photomultiplier tube according to another preferred embodiment of this invention.
Figure 10:
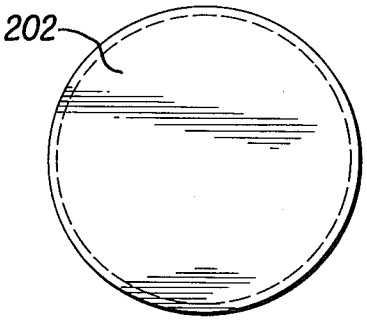
Figure 13B:
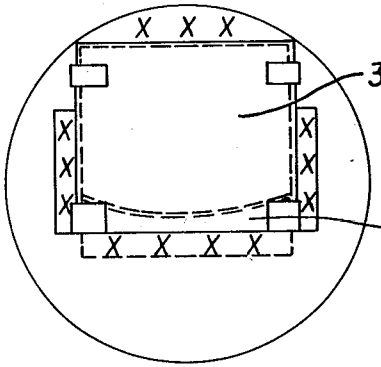
FIGS. 13A and 13B, respectively, are a vertical cross-sectional view and a front elevation view of the first dynode according to the preferred embodiment of FIG. 11.
Figure 14B:
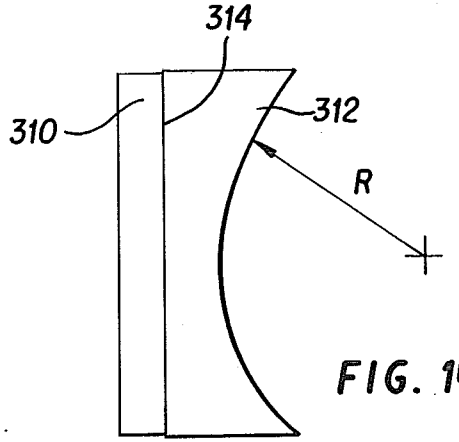
FIGS. 14A and 14B illustrate geometric details of an element interposed between the first and second dynodes according to another aspect of this invention.
Figure 13A:
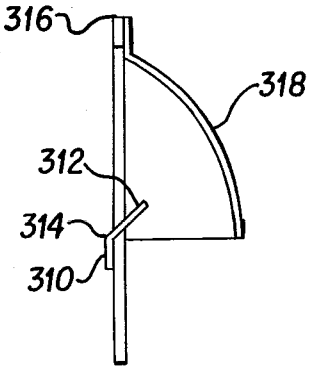
Figure 14A:
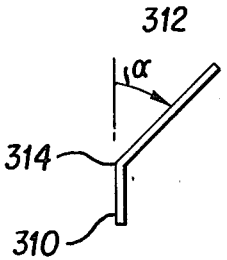
Figure 15A:
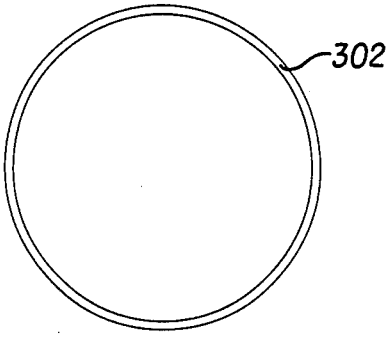
FIGS. 15A and 15B, respectively, are an end view and a vertical cross-sectional view of a focusing electrode to provide a skewed field to the photoelectrons emitted toward the dynodes in the embodiment of FIG. 11.
Figure 15B:
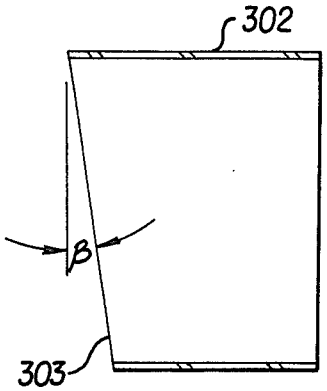

In a second embodiment of the invention, best seen with reference to FIGS. 10 and 11, the photon receiving end of the tube is exactly the same as in the previously described embodiment illustrated in FIG. 9. Thus, photons enter a window 202 and reach photocathode 204 which emits electrons focused by a first focusing electrode 210. In this second embodiment, the second focus electrode, best seen in FIGS. 15A and 15B, has a generally cylindrical form with its front cut at an angle with respect to a plane normal to the axis of the photomultiplier tube. This biased cut second focusing electrode 302 thus has its front end defined by a plane 303 that is normal to the vertical plane through the axis of the photomultiplier tube and forms an angle $\beta$ with a vertical plane normal to the axis of the photomultiplier tube. As persons skilled in the art will appreciate, the value of $\beta$ is related to the degree of off-axis deflection desired for the photoelectrons reaching the first dynode 318 located downstream of the tubulation element 214. $\beta$ preferably is in the range 10° to 20°. A second respect in which the embodiment of FIG. 11 differs from that of FIG. 9 is in the shape of first dynode 318. This dynode 318 is shaped generally like a scoop and has a flanged curved portion (seen in profile in FIG. 11) and two welded, flanged, end portions forming end vertical planes (unnumbered) as indicated in FIG. 13B. This first dynode 318, in this preferred embodiment, is formed of the Ni-Be alloy as described hereinabove and the end pieces are spot-welded to the curved piece to form dynode 318. The end flanges and flanged portion of the curved part of dynode 318 are spot-welded to Kovar(TM) support element 316.

As with the embodiment illustrated in FIG. 9, the embodiment of FIG. 11 has a second dynode 326 that has a generally spherical shape and is formed of Cu-Be alloy of conventional type exactly as was second dynode 226 in the embodiment of FIG. 9. Grid holder 330, best seen in FIG. 16, in this embodiment supports a grid 328 and has the form of a nickel wire mesh, having preferably 20 wires to the inch. Second dynode 326 is supported, as is common with Cu-Be elements, by crimping in the manner indicated in FIG. 7 to be supported by support element 220.

In summary, the principal differences between the embodiment of FIG. 9 and the embodiment of FIG. 11 are that the latter has a biased cut second focusing electrode 302 instead of a right cylindrical second focusing electrode 212, the first dynode 318 has a scooped form and is larger than the spherically formed first dynode 218 and extends in such a manner that the incoming photoelectrons must be focused to arrive at an angle to the photomultiplier tube axis, and first dynode 318 is made of Ni-Be alloy as disclosed herein instead of the conventional Cu-Be alloy used to form first dynode 218.

Figure 17A:
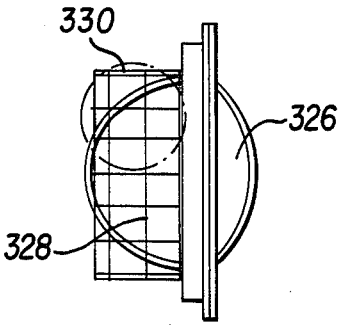
FIGS. 17A–17C, respectively, are the plan, elevation and vertical cross-sectional views of the second dynode according to this invention.
Figure 17B:
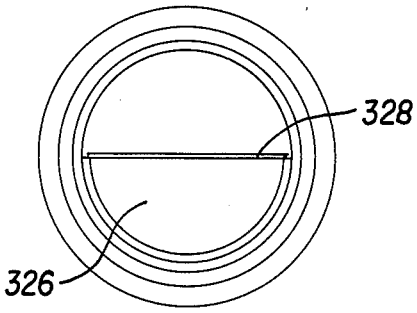
Figure 17C:
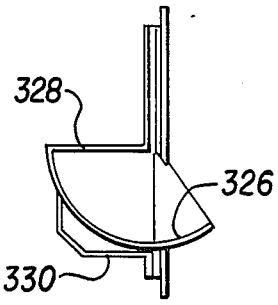

As best seen in FIGS. 17A–17C, in the embodiment of FIG. 9, grid 328 exerts an electric field on electrons emitted from first dynode 328 across the entire area through which they may enter second dynode 326. Second dynode 326 in the embodiment of FIG. 11 is exactly the same in shape and size as second dynode 226 and is, likewise, formed of Cu-Be. Thus, FIGS. 17A–17C are equally applicable in understanding the embodiments of both FIGS. 9 and 11.

Figure 18B:
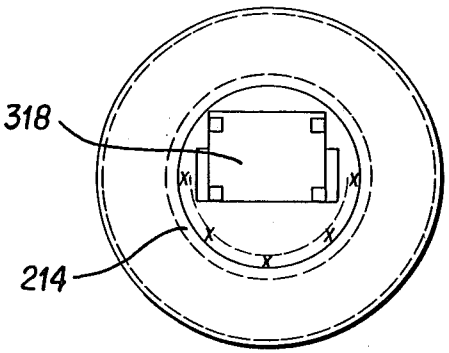
FIGS. 18A and 18B, respectively, are a side elevation view in partial cross-section and an end view of a sealable tubulation element located between the focusing electrodes and the first dynode in a preferred embodiment of this invention.
Figure 18A:
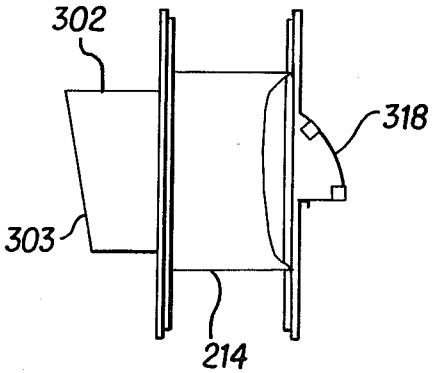

FIGS. 18A and 18B illustrate the juxtaposition of second focusing electrode 302, tubulation body 214 and first dynode 318 as these relate to the embodiment of FIG. 11. Tubulation body 214 basically has the shape of a flanged cylinder coaxial with the photomultiplier tube. They are subsequently pinched off and sealed. The embodiments of both FIGS. 9 and 11 utilize the same tubulation body 214.

The embodiments of both FIGS. 9 and 11 have a plurality of venetian-blind type dynodes, typified by 140, disposed along the axis of the photomultiplier tube in a direction away from the photocathode. As previously noted, the replacement of the conventional Cu-Be alloy by the Ni-Be alloy as disclosed herein enables a designer to form a large suitably shaped first dynode, using spot-welding techniques, to obtain much better control in the very early stages of amplifying the photocathode output, i.e., it starts off the photomultiplying process much more efficiently. The second dynode in both embodiments is the same and may be made of Cu-Be alloy and serves to further amplify the electron flow and guide it into the array of venetian-blind dynodes that follow. As discussed with respect to the background of the prior art, venetian-blind electromultipliers are well known and provide very flexible means by which to control the degree of photomultiplication obtained, simply because the designer is free to add as many stages as he desires. The addition of such stages may tend to slow down the response time commensurately.

Figure 12:
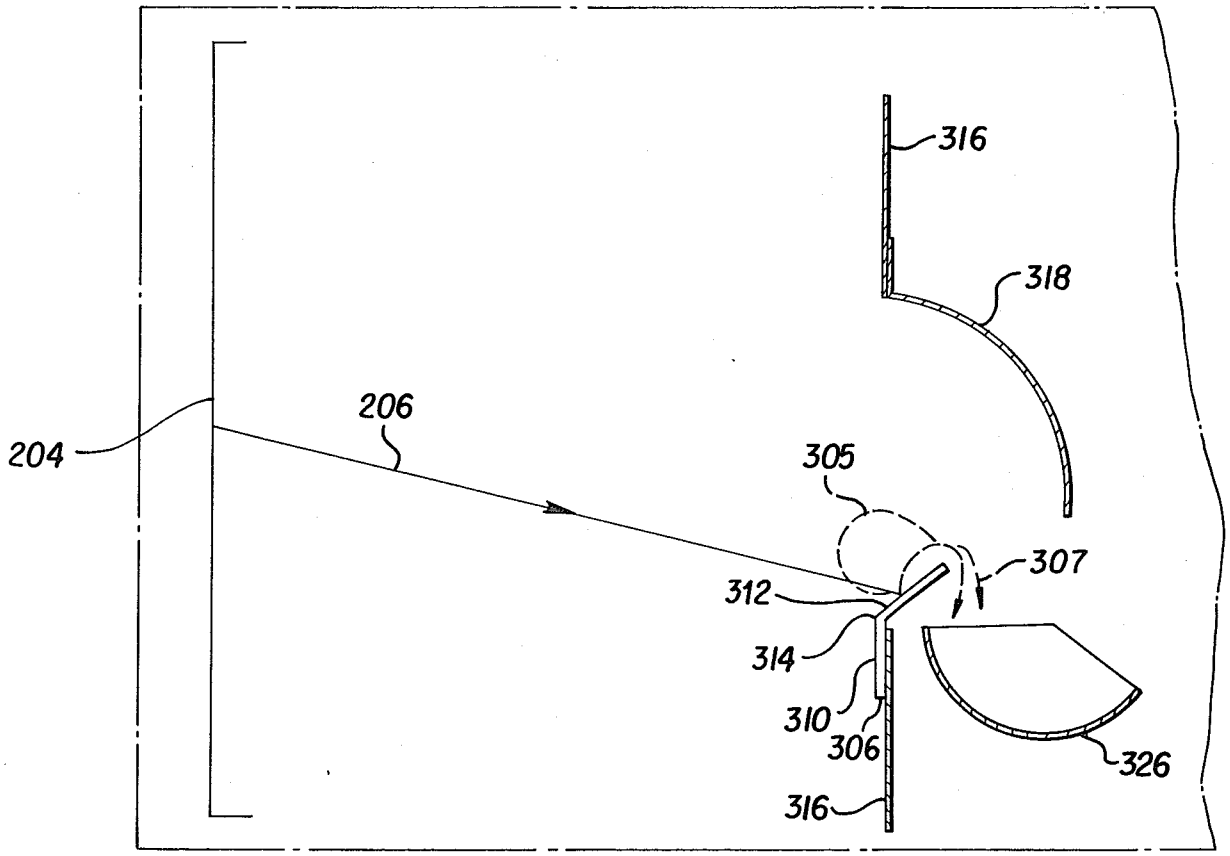
FIG. 12 is a simplified vertical cross-sectional view of the first two dynodes of the type used in the embodiment of FIG. 11.

Experimental research with these embodiments led to a further improvement in the dynode structure, as best understood with reference to FIGS. 12, 13A–13B and 14A–14B. Principally, in order to prevent an undesirable leakage flow of photoelectrons 205 emitted by photocathode 204 bypassing photomultiplication at first dynode 304, a flap 306 is mounted to have a portion extending intermediate to the first and second dynodes 310 and 326. This flap is also preferably made of Ni-Be alloy as disclosed herein and may be spot-welded to Kovar(TM) support element 316. Basically, this flap has an obtuse angle form in tranverse profile, such that one arm 310 forms an obtuse angle (the complement of angle $\alpha$ of 14A) at an apex 314 with a second arm 312. the surface of arm 312 is provided with a layer of BeO for secondary election emission therefrom. As best seen with reference to FIGS. 13B and 14B, the extreme distal edge of arm 312 is preferably shaped as a symmetric circular arc of radius R. As best understood with reference to FIG. 12, the presence of flap 306 serves to intercept photoelectrons 206 which otherwise would bypass the first and second dynodes completely at the BeO covered surface 312. This interception generates secondary electron emission of electrons 305 and 307 which are forced by the prevailing electrostatic fields toward the activated surface of second dynode 326. Thus although two focusing electrodes are deployed in the embodiment of FIG. 11, the efficency of the photomultiplier tube is further enhanced by the inclusion of flap 306 as indicated in FIG. 12. Although the inclusion of such a flap made of Ni-Be alloy is highly beneficial, it is not essential to the realization of the advantages obtained by using a Ni-Be first dynode 318 as discussed previously. $\alpha$ preferably is in the range 35° to 55°.

Figure 19:
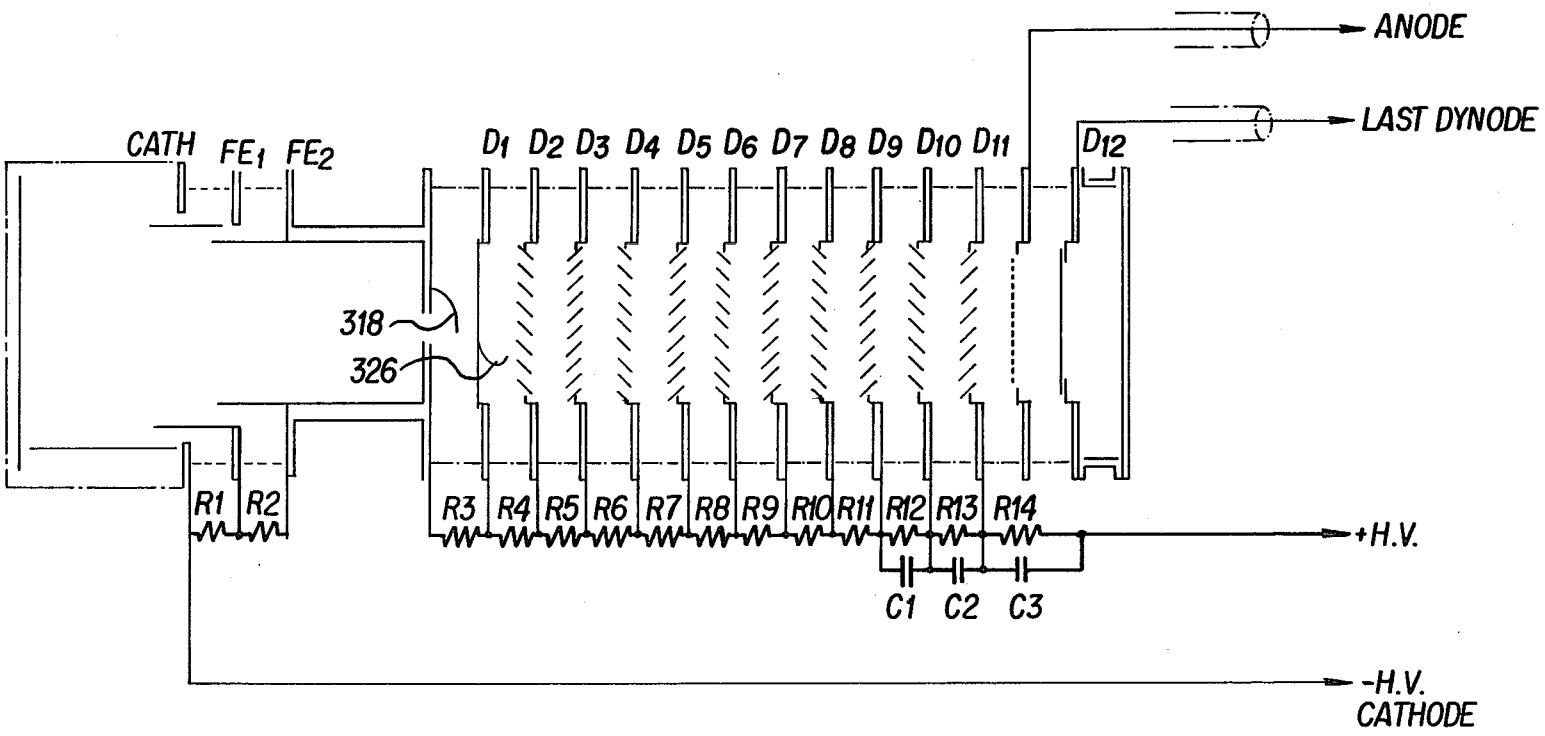
FIG. 19 is a schematic circuit diagram illustrating one manner in which various elements of the preferred embodiment may be electrically related.

FIG. 19, as best understood with reference to the embodiment of FIG. 11, is merely an illustration of how the cathode, the focusing electrodes, the first and second dynodes, and venetian-blind dynodes as well as the anode receiving the enhanced electron flow may conveniently be related to each other. Persons skilled in the art will appreciate from this diagram that the voltage differences between successive dynodes are determined by the values seleced for various electrical resistances, e.g., R3–R14. The details of such circuitry are believed to be within the knowledge of persons skilled in the art and an understanding thereof is not essential to comprehension of the functioning and benefits to be derived from the present invention.

The use of mechanical affixation means, such as crimping, that is conventionally employed in using Cu-Be alloy dynodes, does not always ensure effective electrical contacts and under conditions of high vibrational disturbance or high temperatures may cause a dynode such as the first dynode 218 in the embodiment of FIG. 9, to move from its intended location during use. The employment of Ni-Be alloy, as taught herein, frees the designer to select other and more effective shapes than those known in the prior art because, without sacrificing any quantum efficiency in performance, a dynode made of Ni-Be alloy can be formed of individual segments spot-welded together and the whole may be spot-welded firmly in place within the photomultiplier tube structure.

As is well known, spot-welding ensures not only mechanical strength but also excellent electrical contact. Furthermore any problems of photoelectrons straying without amplification within the first two dynodes can be very efficiently countered by the interposition of Ni-Be flap 310 between the first and second dynodes as disclosed above. These changes over the known art ensure high photomultiplication efficiency and leave the designer free to elect a number of stages of venetian-blind dynodes that he wishes to include in the photomultiplier tube. As persons skilled in the art will appreciate, particularly with reference to FIGS. 7 and 8, even the venetian-blind dynode elements can be formed of Ni-Be alloy as taught herein and firmly affixed by spot-welding to a Kovar(TM) support element. Kovar(TM) is a material that has properties highly compatible with Ni-Be alloy, Cu-Be alloy, and glass, all materials found in photomultiplier tubes. Spot-welding or brazing, both now possible with the Ni-Be alloy as taught herein, thus grant the designer of photomultiplier tubes much greater latitude and flexibility.

It is anticipated that persons skilled in the art, armed with the knowledge provided by this disclosure, will contemplate a variety of modifications in the structure and uses of this invention. All such modifications and variations are expressly contemplated as being encompassed within the claims appended below.

What is claimed is:

1. In a photomultiplier tube structure that includes a photocathode for emitting photoelectrons inresponse to an energy input, a first focusing electrode to focus the emitted photoelectrons with respect to an axis of the photomultiplier tube, at least one dynode element for producing secondary electron emissions and a collecting anode, an improvement comprising:

a first dynode means, comprsising a weldable nickel-beryllium alloy (Ni-Be), positioned in said photomultiplier structure for receiving the focused photoelectrons and thereby emitting a first amplified electron flow;

said first dynode means being formed to have a photoelectron receiving surface layer comprising beryllium oxide;

a second focusing electrode cooperating with the first focusing electrode to focus said emitted photoelectrons into a stream directed at an angle with respect to said photomultiplier tube axis to be received by said receiving surface of said dynode means; and photoelectron leakage reducing means for reducing leakage of said photoelectrons between said first dynode and a second dynode means located intermediate said first dynode and said collecting anode.

2. An improved photomultiplier tube structure according to claim 1, wherein:

said receiving surface is formed to have a cylindrically-shaped portion defined about an axis normal to said photomultiplier tube axis.

3. An improved photomultiplier tube structure according to claim 2, wherein:

said first dynode receiving surface defining axis is offset from said photomultiplier tube axis.

4. An improved photomultiplier tube structure according to claim 1, wherein:

said second dynode means is formed to have a spherically-shaped surface for receiving said first amplified electron flow and thereby emitting a second amplified electron flow, the geometric center corresponding to said second dynode spherically-shaped surface being located intermediate said first dynode receiving surface defining axis and said collecting anode.

5. An im improved photomultiplier tube structure according to claim 1, further comprising:

first control means intermediate said first and second dynode means for controlling said first amplified electron flow therebetween.

6. An improved photomultiplier tube structure according to claim 5, wherein:

said first control means comprises a wire charged to a predetermined electric potential with respect to said first dynode means.

7. An improved photomultiplier tube structure according to claim 1, wherein:

said leakage reducing means is formed to have intersecting first and second planar portions that define an obtuse angle at their line of intersection.

8. An improved photomultiplier tube structure according to claim 7, wherein:

said leakage reducing means is supported in said photomultiplier tube such that a surface of said first planar portion is positioned to receive that portion of said photoelectrons which are travelling in a direction that would cause them to miss reception by said first dynode, whereby a corresponding amplified electron flow is generated at said leakage reducing means and is directed to join said first amplified electron flow received by said second dynode means.

9. An improved photomultiplier tube structure according to claim 8, wherein:

said first planar portion is inclined at an acute angle with respect to said photomultiplier tube axis.

10. An improved photomultiplier tube structure according to claim 9, wherein:

said surface of said first planar portion is defined between said line of intersection and an arcuate edge of said first planar portion symmetrically about a line representing the shortest distance between said line of intersection and said arcuate edge.

* * * * *